US010946243B1

(12) United States Patent
Smith et al.

(10) Patent No.: US 10,946,243 B1
(45) Date of Patent: Mar. 16, 2021

(54) INTEGRATED HOLE-IN-ONE VERIFICATION SYSTEM WITH A PROGRESSIVE REWARD

(71) Applicants: James Smith, Grand Forks, MN (US); Randy Dufault, Grand Forks, MN (US); Clayton Vetter, Grand Forks, MN (US)

(72) Inventors: James Smith, Grand Forks, MN (US); Randy Dufault, Grand Forks, MN (US); Clayton Vetter, Grand Forks, MN (US)

( * ) Notice: Subject to any disclaimer, the term of this patent is extended or adjusted under 35 U.S.C. 154(b) by 0 days.

(21) Appl. No.: 16/389,689

(22) Filed: Apr. 19, 2019

Related U.S. Application Data

(60) Provisional application No. 62/661,438, filed on Apr. 23, 2018.

(51) Int. Cl.
*A63B 71/06* (2006.01)
*A63B 24/00* (2006.01)
*A63B 57/00* (2015.01)

(52) U.S. Cl.
CPC ..... *A63B 24/0062* (2013.01); *A63B 57/505* (2015.10); *A63B 2220/806* (2013.01); *A63B 2220/807* (2013.01); *A63B 2225/20* (2013.01); *A63B 2225/50* (2013.01)

(58) Field of Classification Search
CPC ..... A63B 71/0616
USPC ..... 473/409
See application file for complete search history.

(56) References Cited

U.S. PATENT DOCUMENTS

| | | | | |
|---|---|---|---|---|
| 5,102,140 | A * | 4/1992 | Vincent | A63B 24/0003 473/156 |
| 9,283,464 | B2 * | 3/2016 | Nipper | A63B 24/0021 |
| 2001/0021673 | A1 * | 9/2001 | Cleveland | A63B 71/0605 473/131 |
| 2006/0084529 | A1 * | 4/2006 | Burkons | G06Q 30/02 473/409 |
| 2006/0166734 | A1 * | 7/2006 | Gaites | G07F 17/3258 463/25 |
| 2011/0034223 | A1 * | 2/2011 | O'Leary | G07F 17/3258 463/2 |
| 2011/0230245 | A1 * | 9/2011 | Carr | A63B 24/0059 463/7 |
| 2016/0158624 | A1 * | 6/2016 | Porter | A63B 71/0616 473/409 |

* cited by examiner

*Primary Examiner* — Raeann Gorden
(74) *Attorney, Agent, or Firm* — Michael A. Bondi; Moss & Barnett

(57) ABSTRACT

An integrated hole-in-one verification system with progressive reward, wherein the integrated hole-in-one verification system is associated with a golf hole. The golf hole includes a tee box and a green. The green has a hole. The integrated hole-in-one verification system includes a recording device, an activation device, a storage device and a hole-in-one reward claim device. The recording device is capable of recording at least a portion of the tee box and at least a portion of the green where the hole is located. The activation device causes the recording device to be activated. The storage device receives the recording of at least the portion of the tee box and at least the portion of the green where the hole is located. A hole-in-one reward claim device that when activated causes review of the recording of at least the portion of the tee box and at least the portion of the green where the hole is located to verify the hole-in-one.

7 Claims, 1 Drawing Sheet

INTEGRATED HOLE-IN-ONE VERIFICATION SYSTEM WITH A PROGRESSIVE REWARD

REFERENCE TO RELATED APPLICATION

This application claims priority to Provisional Applic. No. 62/661,438, filed on Apr. 23, 2018, the contents of which are incorporated herein by reference.

FIELD OF THE INVENTION

The invention relates to monitoring a sporting event. More particularly, the invention relates to an integrated hole-in-one verification system with a progressive reward.

BACKGROUND OF THE INVENTION

A popular technique to increase people to participate in golf outings is to offer a large reward such as a new vehicle, if a player hits a hole-in-one on a particular golf hole. To cover the cost of this large reward, the golf course or the event organizer will often purchase an insurance policy.

One of the typical requirements of the insurance policy is that a person from the insurance company, the golf course or the event monitors the golf hole to confirm whether a hole-in-one is valid. The need to have a person monitor the golf hole limits the ability to offer the hole-in-one reward to events where there are a large number of people golfing so as to cover the cost of the person monitoring the golf hole as well as the cost of the insurance policy.

SUMMARY OF THE INVENTION

An embodiment of the invention is directed to an integrated hole-in-one verification system with progressive reward. The integrated hole-in-one verification system is associated with a golf hole. The golf hole includes a tee box and a green. The green has a hole. The integrated hole-in-one verification system includes a recording device, an activation device, a storage device and a hole-in-one claim device. The recording device is capable of recording at least a portion of the tee box and at least a portion of the green where the hole is located. The activation device causes the recording device to be activated. The storage device receives the recording of at least the portion of the tee box and at least the portion of the green where the hole is located. The hole-in-one reward claim device that when activated causes review of the recording of at least the portion of the tee box and at least the portion of the green where the hole is located to verify the hole-in-one.

Another embodiment of the invention is directed to a method of using integrated hole-in-one verification system with a progressive reward. The integrated hole-in-one verification system is associated with a golf hole. The golf hole includes a tee box and a green. The green has a hole. A recording device is activated. A golf ball is hit from the tee box towards the hole. The hitting of the golf ball from the tee box is recorded with a recording device. Movement of the golf ball on the green is recorded with the recording device. The recording of hitting of the golf ball from the tee box and the recording of the movement of the golf ball on the green are stored with a storage device. In response to submission of a hole-in-one claim, the recording of the hitting of the golf ball from the tee box and the recording of the movement of the golf ball on the green are reviewed to verify if a hole-in-one has occurred. A reward is provided if the hitting of the hole-in-one is verified.

Another embodiment of the invention is directed to a method of using an integrated verification system with a progressive reward in conjunction with at least one of a hole-in-one, a longest drive, hitting a shot of more than a specified distance, a longest put, hitting a put of more than a specified distance and closest to the hole. The integrated hole-in-one verification system is associated with a golf hole. The golf hole includes a tee box and a green. The green has a hole. A recording device is activated. A golf ball is hit on a golf hole. The hitting of the golf ball is recorded with a recording device. The recording of hitting of the golf ball is stored with a storage device. In response to submission of a claim, the recording of the hitting of the golf ball is reviewed to determine if the claim is verified. A reward is provided if the claim is verified.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE INVENTION

Figure 1:
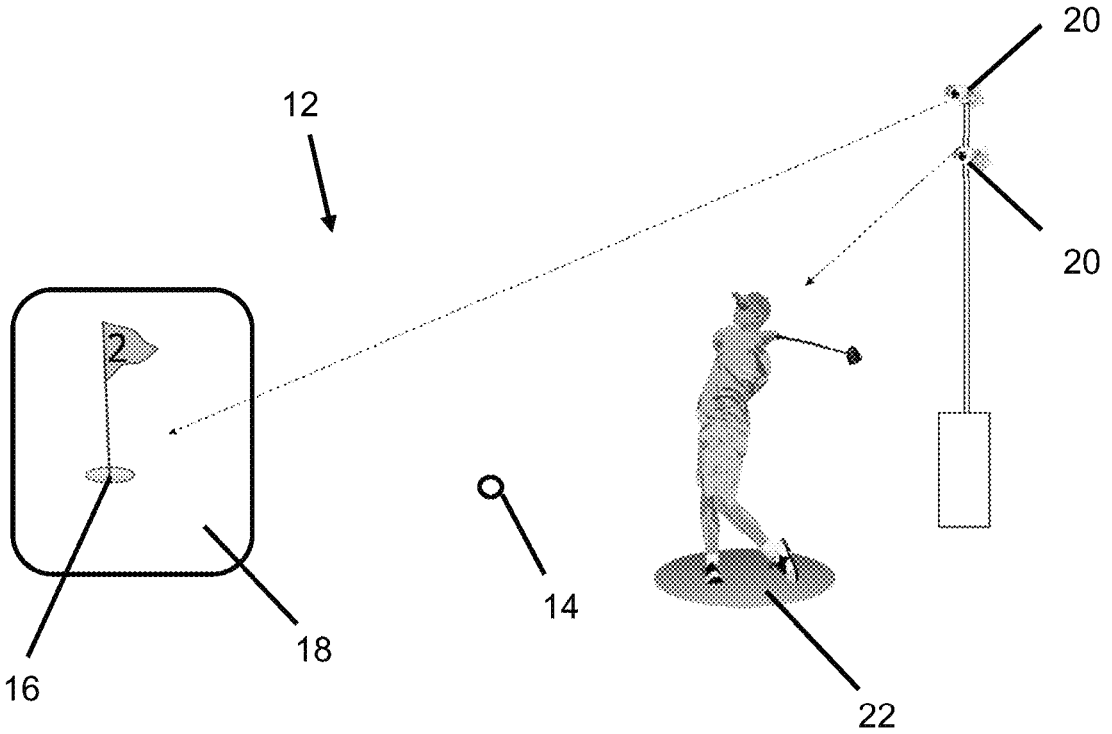
FIG. 1 is an illustration of an integrated hole-in-one verification system according to an embodiment of the invention.

An embodiment of the invention is directed to an integrated hole-in-one verification system as illustrated and described herein. In one embodiment, the integrated hole-in-one verification system is used in conjunction with at least one golf hole that offers a reward to a golfer who hits a hole-in-one on the golf hole. The integrated hole-in-one verification system enables a reward to be offered without in-person monitoring of the golf hole on which the reward is being offered.

In certain embodiments, the integrated hole-in-one verification system is used in conjunction with a par three golf hole having a length of less than about 200 yards such that it is possible for many golfers to hit a hole-in-one. A person of skill in the art will appreciate that the concepts of the invention may be adapted for alternative configurations. An example of which is a longer golf hole.

The concepts of the invention may also be used in conjunction with other skill events in golf; examples of which include longest drive, hitting a drive of more than a specified distance, longest put, sinking a put of more than a specified distance and closest to the pin.

The integrated hole-in-one verification system 10 includes at least one recording device 20 that is capable of capturing at least one of video, images and sound associated with a golf hole 12 on which the reward is offered. In certain embodiments, the at least one recording device 20 records video of a person hitting a golf ball 14 at the tee box 22.

The at least one recording device 20 may also record video of the green on the golf hole 12 to determine if the golf ball 14 hit by the golfer goes into a hole 16 located on the green 18. The presence of the at least one recording device 20 proximate the tee box 22 that is visible to the golfer may provide a deterrent to the golfer claiming a hole-in-one where the golf ball 14 did not fall into the hole 16 on the first hit.

In one embodiment, the at least one recording device 20 has a focusing mechanism that provides the at least one recording device 20 with the ability to focus on the tee box 22 when the golf ball 14 is struck by the golfer as well as to focus on the area proximate the hole 16 on the green 18 to determine if the golf ball 14 goes into the hole 16.

Depending on the location of the tee box 22 and the hole 16 on the green 18, the at least one recording device 20 may pivot or rotate after the golf ball 14 is struck to be directed to the hole 16 on the green 18. In another embodiment, there is a first recording device 20 that is directed at a portion of the tee box 22 where the golfer is hitting the golf ball 14 and a second recording device 20 that is directed at the hole 16 on the green 18 as illustrated in FIG. 1.

This configuration may provide enhanced performance because the first recording device 20 may be fabricated with a first focusing mechanism that is optimized for viewing the golfer in the tee box 22 and the second recording device 20 may be fabricated with a second focusing mechanism that is optimized for viewing the hole 16 on the green 18.

While FIG. 1 illustrates that there is one recording device 20 mounted proximate the tee box 22, the recording device 20 may be located proximate the green 18 and such recording device 20 is capable of recording the golfer in the tee box 18 as well as the hole 16 on the green 18. In another embodiment, it is possible for the first recording device 20 to be mounted proximate the tee box 22 and the second recording device 20 to be mounted proximate the green 18.

The system may also include at least one intermediate recording device (not shown) that is configured to capture video, image or sound associated with the golf ball 14 at an intermediate location between the tee box 22 and the green 18.

The video or images captured by the recording device 20 may include a time and date stamp to minimize the potential that the image will be altered in an attempt to claim a reward for which a hole-in-one was not struck.

The invention may be configured so that individual golfers who desire to participate are required to register. A person of skill in the art will appreciate that there are a variety of mechanisms by which the golfer could use to register. For example, the golfers may use a mobile application or a unit located at the golf course to register. In another embodiment, the golfer may work with an employee of the golf course or the company running a golf event to complete the registration.

The invention may be configured so that golfers who desire to participate may be required to provide a payment. A person of skill in the art will appreciate that there are a variety of mechanisms by which the golfer could provide the payment such as swiping a credit card or authorizing charging the payment to a stored credit card, debit card or bank account. The golfer may use a mobile application or a unit at the golf course to submit the payment. In another embodiment, the golfer may work with an employee of the golf course or the company running a golf event to submit the payment.

Figure 2:
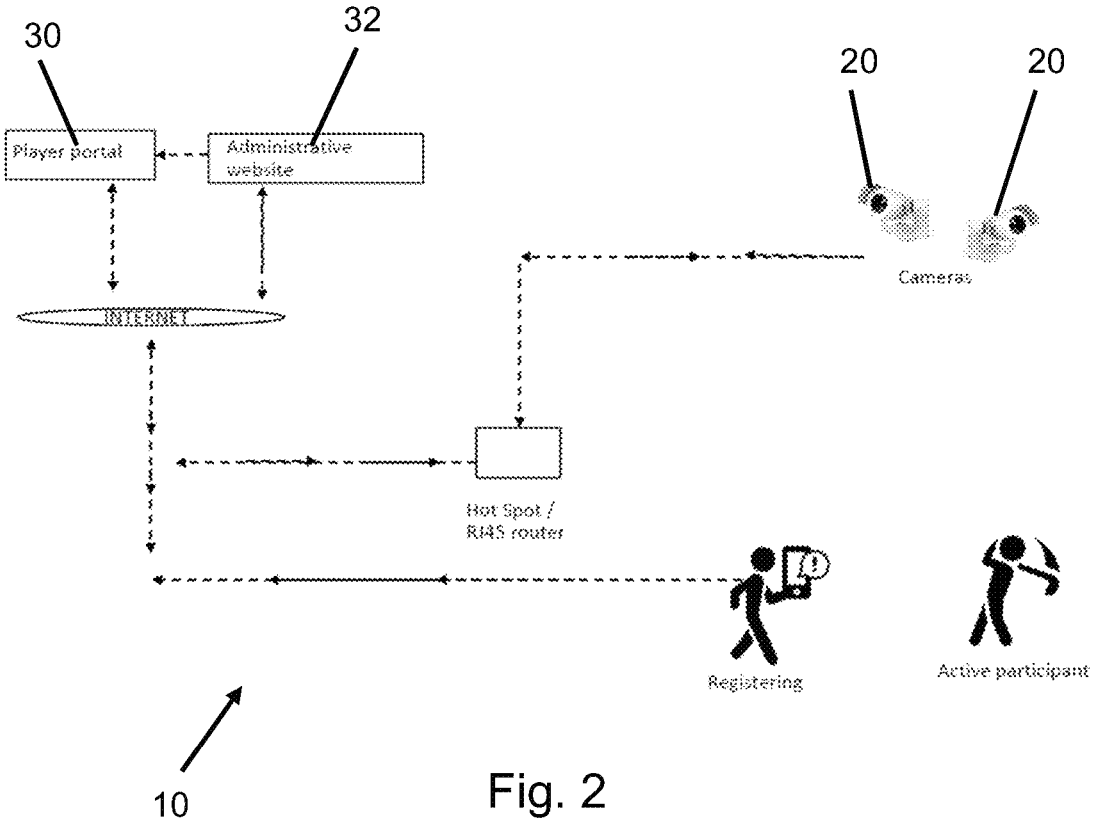
FIG. 2 is a schematic illustration of data flow associated with the integrated hole-in-one verification system.

The registration information and the payment information are transmitted to a player portal 30, which is illustrated in FIG. 2. The player portal 30 may be located at a facility of the company that is running the integrated hole-in-one verification system. A person of skill in the art will appreciate that a variety of mechanisms may be used to transmit the registration and payment information to the player portal 30.

In an alternative embodiment, the golfer may become a member which allows the golfer to play for a number of the hole-in-one rewards in a specified period of time. For example, the membership may have a monthly fee that allows the golfer to play for one of the hole-in-one rewards each day.

In certain embodiments, all golfers using a golf course may be able to elect to participate for the hole-in-one reward. In other embodiments, every person that participates in a particular golf event may be entered into the golf event as part of the process for registering for the golf tournament or outing such that no additional payment is required. In such situations, the registration may be handled through the golf course as part of signing up for the golf event or the golfer may be required to submit a separate registration for the golf event to be able to compete for the reward.

The integrated hole-in-one verification system may be associated with a mobile application or website for the golfer who is participating to obtain information relating to the golf reward opportunity such as the number and locations of the winners. The mobile application may include push notifications such as to alert the golfer of current golf rewards. Such notifications may also be sent by other mechanisms such as email and text.

At least a portion of the components associated with the integrated hole-in-one verification system that are located at the golf course may be powered using solar energy. Such a configuration obviates needing to connect such components to a power source at the golf course, which may be difficult because the components that are located at the golf hole may be a significant distance from an available power source.

The components of the integrated hole-in-one verification system that are located at the golf course may communicate with each other and with the home office using a variety of techniques, examples of suitable techniques include wired, Wi-Fi and cellular networks. Using a wireless communication mechanism reduces the cost associated with installing the system as compared to a wired communication network.

The portion of the integrated hole-in-one verification system that is located at the golf course that includes a controller associated with a battery system and a solar panel. The system also includes at least one camera that is operably connected to the controller such as with a power switch/battery sensor. The system further includes a hot spot/RJ45 router for communicating with the home office.

An Arduino controller may be included to control the operation of the components. For example, the components may be configured to shut off the cameras until needed. The controller may be configured to be turned off during hours in which the golf course is closed. The controller may be configured to relay battery and charging information to the home office to ensure that the system has sufficient power during hours of operation.

The integrated hole-in-one verification system relies on a good visibility of the golf ball at the tee box and on the green to verify the hole-in-one. The camera may also be turned off during periods of reduced visibility such as during a storm. A person of skill in the art will appreciate that a variety of sensors may be used to determine when the camera should be turned off. The integrated hole-in-one verification system may notify the golfer when the integrated hole-in-one verification system is not available.

The system may also include a revel beacon that communicates with mobile phones such as through Bluetooth to determine when golfers are in proximity to the golf hole on which the hole-in-one reward is being offered so that the golfers can be notified of the availability of the golf reward.

FIG. 2 illustrates a data/video transfer/archiving process associated with the integrated hole-in-one verification system 10. Data from the recording devices 20 is transmitted to the internet such as with the hot spot/RJ45 router. Data associated with the golfer being in proximity to the revel beacon may be transmitted to the internet through the mobile phone that is in communication with the revel beacon.

The home office may be in communication with the internet to store contact and other information associated with the golfers in the player portal 30, as well as the video and/or image data in the storage device 32 in case such video and/or image data is needed to confirm that one of the golfers shot a hole-in-one. The player portal 30 such as using a web site may be separate from an administrative portal and/or the storage device.

For example, when the home office receives information about a golfer being ready to participate in the golf reward, the home office verifies that the person is registered and then activates the integrated hole-in-one verification system so that the activity of the golfer is recorded.

In operation, the golfer registers and provides payment where necessary. The golfer may be required to enter identification information to activate the integrated hole-in-one verification system before hitting the golf ball.

After the system is activated such as by pressing a start button on a mobile application, the golfer may be provided with a specified period of time in which the integrated hole-in-one verification system will remain activated. Once this period of time ends, the hitting of the golf ball 14 will not berecorded and the golfer is unable to obtain a reward for hitting a hole-in-one. If the golfer does not hit the golf ball 14 within the specified period of time, the integrated hole-in-one verification system may provide the golfer to reactivate the system or the golfer may be offered a refund.

The golfer then hits the golf ball 14 from the tee box 22. The recording device 20 records the hitting of the golf ball 14 at the tee box 22 and the hole 16 on the green 18 so that it can be confirmed whether the shot was a hole-in-one.

If the shot is a hole-in-one, the golfer will submit a claim for the reward such as through the golf course or through a unit that is positioned proximate the golf hole. In certain embodiments, the golfer may press a button on the mobile phone application. In alternative embodiments, there may be a claim button mounted proximate the golf hole 12.

This claim submission will trigger a review of the aspects of the golf shot. In situations where the ability to transmit data to the home office is reduced or where there is a desire to reduce the amount of data that is transferred to the home office, the submission of the claim may cause the video, images and sounds associated with the golf hole to be transmitted to the home office. The golfer will be notified that the reward for the hole-in-one will be received after the video and/or images are reviewed to ensure that the golf shot was a hole-in-one.

If there is a malfunction of the components associated with the integrated hole-in-one verification system or if the hole-in-one cannot be verified, the reward may be canceled or not provided.

To minimize the potential of the golfer being frustrated by the inability to verify the hole-in-one, the integrated hole-in-one verification system 10 may verify the operational status of the integrated hole-in-one verification system 10 prior to the golfer hitting the golf ball 14. This verification may include the ability of the recording device(s) 20 to record the video, sound and/or image data at the tee box 22 and the green 18 proximate to the hole 16 as well as the ability to transmit the video, sound and/or image data from the recording device(s) to the storage device 32.

There may be a test image provided of the tee box 22 and/or the green 18 that is used to confirm the ability of the recording device(s) to record the video and/or image data. The test image may have a known size, shape and/or color such that if the recording device(s) is not able to record the video and/or image data associated with the test image and then successfully transmit this data to the storage device 32, the integrated hole-in-one verification system 10 will not be activated. The golfer will be notified of this status and the home office will be notified of this status.

An additional option for the integrated hole-in-one verification system is to be more than one level of reward. The first reward level is received for hitting a hole-in-one on the golf hole where the reward is offered. Part of the reward associated with the hole-in-one may be a trip where all of the people who hit the hole-in-one will compete for a larger reward. The second reward level may be larger than the first reward level. In certain embodiments, the second reward level is $1,000,000.

There may also be advertisements associated with aspects of the integrated hole-in-one verification system with the revenue received therefrom potentially being used to fund the progressive pot. For example, the advertisements may be placed on components of the registration and/or monitoring system that are located at the golf course. The advertisements may also be incorporated into the mobile application and/or website that are associated with the integrated hole-in-one verification system.

In addition to having the golf reward on a single hole on a single golf course, the golf reward may be simultaneously offered on a number of golf holes and/or at a number of golf courses.

Especially when the integrated hole-in-one verification system is utilized on multiple holes and/or at multiple golf courses, the invention may include a progressive pot that receives a contribution from each hole that is played and/or each payment that is received. The progressive jackpot may be transmitted to the golfers who have registered to encourage the golfers to go to courses on which the invention is utilized for a chance to get the progressive jackpot. Alternatively or additionally, this progressive pot may be displayed at each of the golf holes that are associated with the golf event to encourage participation in the golf event.

While the invention is described above with respect to use in conjunction with a hole on a golf course, the concepts of the invention may be used in conjunction with other sports skill events, examples on which include hitting home runs in a baseball or softball field or making a basketball shot from a particular distance.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A method of using an integrated verification system with a progressive reward in conjunction with at least one of a hole-in-one, a longest drive, hitting a shot of more than a specified distance, a longest put, hitting a put of more than a specified distance and closest to the hole, wherein the integrated hole-in-one verification system is associated with a golf hole, wherein the golf hole comprises a tee box and a green, wherein the green comprises a hole and wherein the method comprises:

mounting a recording device proximate the golf hole so that the recording device is a capable of recording video of the tee box and the green;

activating the recording device;

providing a first test image of at least one of the tee box and the green;

recording a second test image of the at least one of the tee box and the green with the recording device;

comparing the second test image to the first test image and if the second test image does not match the first test image, issuing a notification that the integrated verification system is not available and it is not possible to receive a reward relating to hitting a golf ball;

hitting the golf ball on the golf hole;

recording the hitting of the golf ball with the recording device;

storing the recording of hitting of the golf ball with the storage device;

in response to submission of a claim, reviewing the recording of the hitting of the golf ball to determine if the claim is verified; and providing the reward if the claim is verified.

2. The method of claim 1, and further comprising:

turning off the recording device during periods of reduced visibility; and issuing a notification that the integrated verification system is not available.

3. The method of claim 1, and further comprising submitting a registration prior to activating the recording device, wherein the registration comprises at least one of identifying information and contact information of a person desiring to hit the golf ball.

4. The method of claim 1, and further comprising submitting a payment prior to activating the recording device.

5. The method of claim 4, and for each payment that is submitted, increasing an amount of the progressive reward.

6. The method of claim 1, wherein the recording device is capable of recording at least one of video, images and sound.

7. The method of claim 1, wherein the recording device comprises a focusing mechanism.

* * * * *